US005392919A

United States Patent [19]

Passamoni

[11] Patent Number: 5,392,919

[45] Date of Patent: Feb. 28, 1995

[54] CAPTURE DISPLAY PACKAGE

[75] Inventor: Phillip L. Passamoni, Green Bay, Wis.

[73] Assignee: Green Bay Packaging, Inc., Green Bay, Wis.

[21] Appl. No.: 91,588

[22] Filed: Jul. 13, 1993

[51] Int. Cl.[6] ..... B65D 75/00

[52] U.S. Cl. ..... 206/576; 206/223; 206/333; 206/485; 206/489; 206/577

[58] Field of Search ..... 206/223, 485, 488, 45.14, 206/333, 320, 576, 577, 489

[56] References Cited

U.S. PATENT DOCUMENTS

| | | | |
|---|---|---|---|
| 2,226,409 | 12/1940 | Patterson et al. . | |
| 2,805,033 | 9/1957 | Rous | 206/491 X |
| 2,913,101 | 11/1959 | Daily | 206/45.19 |
| 2,983,368 | 5/1961 | Vander Lugt, Jr. | 206/45.14 |
| 3,002,722 | 10/1961 | Cote | 206/45.14 X |
| 3,184,046 | 5/1965 | Berg | 206/491 X |
| 3,874,500 | 4/1975 | Nicholl | 206/45.19 X |
| 3,918,583 | 11/1975 | Adams | 206/485 |
| 4,046,251 | 9/1977 | Brumi | 206/485 |
| 4,171,050 | 10/1979 | Murray et al. | 206/485 |
| 4,300,683 | 11/1981 | Roccaforte | 206/485 |
| 4,549,654 | 10/1985 | Tiesman | 206/488 |
| 5,048,677 | 9/1991 | Pedracine | 206/45.14 |

*Primary Examiner*—Jimmy G. Foster
*Attorney, Agent, or Firm*—Andrus, Sceales, Starke & Sawall

[57] ABSTRACT

A package for an elongated object such as a flashlight consists of a front panel and a rear panel, with two or more spaced V-shaped ribs being formed in the front panel. One end of the object is engaged with a first one of the ribs, and the opposite end of the object is engaged by the second one of the ribs in a manner such that the portion of the object between the ribs is exposed. Openings are formed in the walls of the front panel defining the ribs, and are configured in a manner so as to positively retain both ends of the object in position relative to the ribs once the front and rear panels are secured together. The package further includes a third rib spaced from one of the first or second ribs. Openings are formed in the third rib and the adjacent rib so as to receive end package objects such as batteries for the flashlight in a manner such that a portion of the length of the batteries is exposed between the ribs.

6 Claims, 2 Drawing Sheets

CAPTURE DISPLAY PACKAGE

BACKGROUND AND SUMMARY

This invention relates to packaging, and more particularly to a package for an elongated object such as a flashlight in which at least a portion of the packaged object is exposed.

Various packages are known in the prior art for packaging of elongated objects, in which the package is made up of a rear panel and a front panel which is folded to define outwardly extending ribs, with the unfolded portions of the front panel being secured to the rear panel. An example of this construction is Cote U.S. Pat. No. 3,022,722, which illustrates upper and lower V-shaped ribs. An opening is formed in the upper wall of the lower rib, and a pair of aligned openings are formed in the upper and lower walls of the upper rib, extending rearwardly from the fold line of the upper rib. With this construction, the package is assembled and transformed to the location at which the object is to be packaged, where the base of the object is placed through the opening in the upper wall of the lower rib, and the upper end of the object is "snapped" into the passage in the upper rib defined by the aligned openings in the upper and lower walls of the upper rib. This construction provides a package which generally functions satisfactorily in retaining the object in position during shipping, handling and display. However, it is possible for the object to be removed from the package during display, simply by reversing the above steps carried out in placing the object into the package.

It is an object of the present invention to provide a folded-panel package for an elongated object, such as a flashlight or the like, in which the object is securely retained in engagement with the package in a manner preventing the object from being removed from the package without destroying the package. It is another object of the invention to provide such a package in which a substantial portion of the object is exposed for viewing by potential consumers. It is a further object of the invention to provide a folded-panel package capable of packaging other objects along with the elongated object, such as batteries and/or flashlights having a different size and shape. Yet another object of the invention is to provide a folded-panel package which is simple in its construction yet which provides highly satisfactory performance in retaining the objects in engagement with the package after placement of the objects in the package.

In accordance with one aspect of the invention, a package for an elongated object defining spaced first and second ends includes a rear panel against which the object is located, and a front panel secured to the rear panel. A first outwardly extending rib is formed in the front panel, and includes an opening for receiving and engaging the object toward its first end. A second outwardly extending rib is formed in the front panel, and has an opening for receiving and engaging the object toward its second end. The first and second ribs are arranged such that at least a portion of the object between its first and second ends is exposed therebetween. The rear panel functions to retain the object adjacent its first and second ends in engagement with the first and second ribs, respectively, to maintain the object in the package. The first and second ribs are each V-shaped, being formed by a pair of walls with a fold line therebetween. The first and second ribs define facing walls in which the openings in the first and second ribs, respectively, are formed such that the edges of the first and second ribs adjacent the openings engage the object adjacent its first and second ends, respectively. A third outwardly extending V-shaped rib may be formed in the front panel. Like the first and second ribs, the third rib is formed by a pair of walls with a fold line therebetween. The second rib is located between the first and third ribs, and the second and third ribs define facing walls with openings therein for receiving one or more second objects therein such that a portion of each of the second objects between the second and third ribs is exposed. As noted previously, the first object may be a flashlight and the second object may be one or more batteries for the flashlight. One end of each of the first and second objects is enclosed by the second rib, and the ends of the objects engage each other to maintain the first and second objects in longitudinal position within the package. The opposite end of the second object is received within an opening formed in a wall of the third rib.

In one form, the first end of the object includes a recess, and the opening formed in the first rib is formed in the inner wall of the first rib in a manner defining a cut-out flap, with the flap being engaged with the recess in the first end of the object. This functions to assist in retaining the object in engagement with the first rib. The recess in the first end of the object is defined by a lip, and the opening in the inner wall of the first rib is formed so as to engage the lip.

In another form, the first end of the object defines an external shoulder, e.g. a shoulder from which the lip defining the recess extends. A first opening is formed in the inner wall of the first rib through which the object extends. A second opening is formed in the outer wall of the first rib, and the second opening is configured so as to engage the shoulder defined by the first end of the object to retain the object in position.

The invention further contemplates a method of packaging an elongated object defining spaced first and second ends. The method involves the steps of providing a package including a pair of panels, and folding portions of a first one of the panels to provide at least first and second spaced ribs. Openings are formed in the folded portions of the first panel, and the elongated object is placed into the openings. The ribs and the openings are arranged such that the ribs engage the spaced first and second ends of the object to prevent outward movement of the object relative to the first panel. The second panel is then secured to the unfolded portions of the first panel to prevent movement of the object in the opposite direction, for positively securing the object within the package. The details of the method are substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
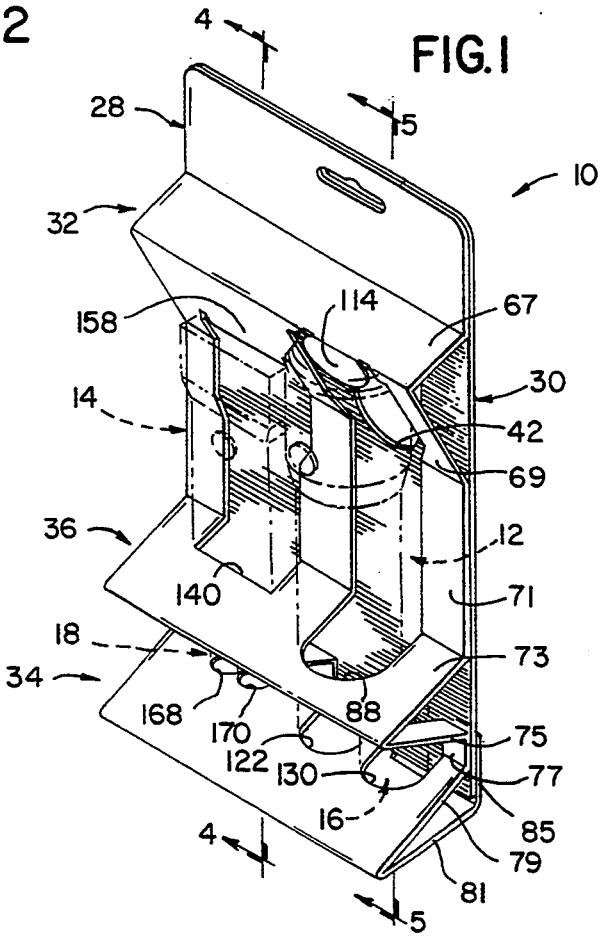
FIG. 1 is an isometric view illustrating one embodiment of a package constructed according to the invention.
Figure 3:
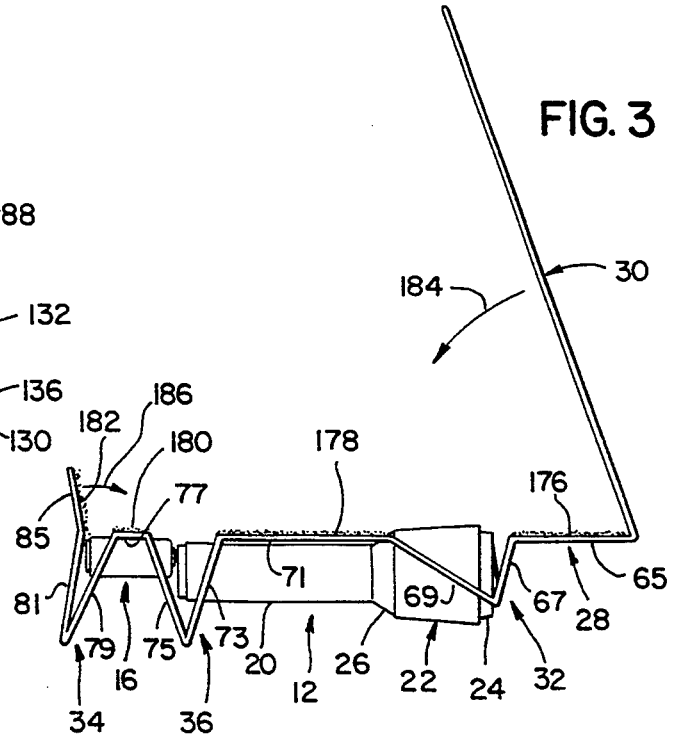
FIG. 3 is a side elevation showing the package blank of FIG. 2 folded for receiving the objects within the folded ribs.

FIG. 1 illustrates a package 10 constructed according to the invention for packaging a pair of elongated objects such as a pair of flashlights 12, 14 and a series of batteries 16, 18 for use with flashlights 12, 14, respectively. Referring briefly to FIG. 3, flashlight 12 is a conventional flashlight having a cylindrical handle 20 within which batteries 16 are adapted to be received, and a head 22 housing a lens and a bulb. Head 22 defines an outwardly extending lip 24 which protects the lens, and an angled section 26 is located between handle 20 and head 22. Flashlight 14 is somewhat similar in construction to flashlight 12, having a handle within which batteries 18 are adapted to be received and a head housing a bulb and a lens, and including an outwardly extending lip for protecting the lens. However, the handle and head of flashlight 14 are rectangular in cross-section, and flashlight 14 has a shorter overall length than that of flashlight 12. Batteries 16 are conventional C-sized or D-sized cylindrical batteries, and batteries 18 are conventional A-sized cylindrical batteries.

As shown in FIG. 1, package 10 consists of a front panel 28 and a rear panel 30. Portions of front panel 28 are folded to define a series of ribs, generally including an upper rib 32, a lower rib 34 and an intermediate rib 36.

Figure 2:
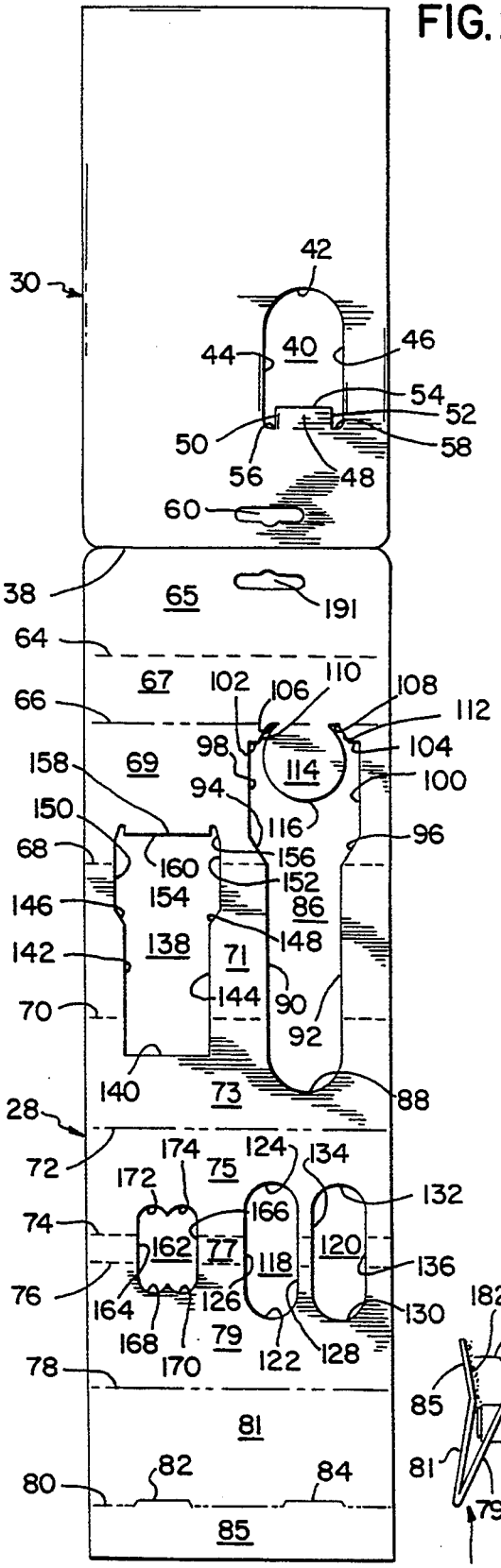
FIG. 2 is a plan view of a package blank from which the package of FIG. 1 is constructed.

FIG. 2 illustrates a blank from which package 10 is constructed. As shown in FIG. 2, the blank includes panels 28, 30, which are separated by a fold line 38.

Rear panel 30 is generally rectangular in plan, having an opening 40 formed therein. Opening 40 is defined by a semicircular edge 42 and a pair of parallel side edges 44, 46. Rear panel 30 includes a tab 48, defined by a pair of parallel edges 50, 52 and a transverse edge 54 of opening 40. A pair of spaced end edges 56, 58 interconnect parallel edges 50, 52 and side edges 44, 46, respectively, of opening 40.

Rear panel 30 further includes a hang opening 60.

A series of transverse partial perforations or fold lines are formed in front panel 28 including, from top to bottom, a front side perforation 64 cooperating with fold line 38 to define an upper wall 65 therebetween, a rear side perforation 66 cooperating with perforation 64 to define a rib upper wall 67 therebetween, a front side perforation 68 cooperating with perforation 66 to define a rib lower wall 69 therebetween, a front side perforation 70 cooperating with perforation 68 to define a central wall 71 therebetween, a rear side perforation 72 cooperating with perforation 70 to define a rib upper wall 73 therebetween, a front side perforation 74 cooperating with perforation 72 to define a rib lower wall 75 therebetween, a front side perforation 76 cooperating with perforation 74 to define a lower wall 77 therebetween, a rear side perforation 78 cooperating with perforation 76 to define a rib upper wall 79 therebetween, and a front side perforation 80 cooperating with perforation 78 to define a rib lower wall 81 therebetween. A pair of three-sided die cuts 82, 84 are formed along with front side perforation 80. A flap 85 is defined between perforation 80 and the lower end of front panel 28.

Perforations 64, 66, 68, 70, 72, 74, 76 and 80 preferably extend only partially through front panel 28, such that each front side perforation extends through only a portion of the thickness of panel 28 leaving the rear surface intact, and each rear side perforation extends only partially through the thickness of panel 28 leaving the front surface intact.

A first opening 86 is formed in front panel 28. Opening 86 extends from rear side perforation 66 past front side perforation 70, encompassing walls 69 and 71, and a portion of wall 73. Opening 86 includes a semicircular edge 88, the center point of which is approximately midway through the height of wall 73. A pair of parallel side edges 90, 92 extend from semicircular edge 88, extending through wall 73 and the full height of wall 71, terminating at front side perforation 68. A pair of divergent angled edges 94, 96 extend between parallel side edges 90, 92, respectively, and a second pair of parallel side edges 98, 100, respectively, formed in wall 69. Opening 86 is further defined by spaced, staggered end edges 102, 104 and 106, 108 oriented parallel to rear side perforation 66, with edges 106, 108 lying along rear side perforation 66. Convergent angled edges 110, 112 extend between staggered end edges 102, 106 and 104, 108, respectively.

A truncated circular tab 114 is defined between the innermost points of end edges 106, 108, providing a circular edge 116 extending therebetween. Tab 114 is formed by a portion of the material of wall 69 which remains after opening 86 is cut out in the manner described. Tab 114 is adapted to bend rearwardly at rear side perforation 66, which defines the truncated end of tab 114.

A pair of oval openings 118, 120 are formed in front panel 28 below opening 86. Oval opening 118 defines semicircular end edges 122, 124 with a pair of parallel side edges 126, 128, respectively, extending therebetween. Similarly, oval opening 120 defines a pair of semicircular end edges 130, 132, with a pair of parallel side edges 134, 136, respectively, extending therebetween. Oval openings 118, 120 are identical in construction, extending throughout wall 77 and partially through walls 75, 79. Semicircular end edges 124, 132 define an outermost point approximately midway through the height of wall 75 above front side perforation 74, and semicircular end edges 122, 130 are located an equal distance below front side perforation 76.

Openings 86 and 40 in front and rear panels 28, 30, respectively, lie along a common longitudinal axis, about which openings 118, 120 are symmetrical. That is, the common longitudinal axis along which openings 86 and 40 lie is located midway between the longitudinal axes of openings 118, 120.

A second opening 138 is formed in front panel 28 adjacent opening 86. Opening 138 is defined by a transverse end edge 140, a pair of spaced parallel lower side edges 142, 144, a pair of diverging angled edges 146, 148, a pair of spaced parallel upper side edges 150, 152, and a pair of convergent angled upper end side edges 154, 156. An upper tab 158 is defined by a transverse upper edge 160 and oppositely oriented inverted L-shaped edges extending between the opposite ends of edge 160 and the upper ends of edges 154, 156. Opening 138 extends throughout the height of wall 71, and partially through wall 73 below front side perforation 70 and partially through wall 69 above front side perforation 68.

A lower opening 162 is formed in front panel 28 adjacent openings 118, 120. Opening 162 consists of a pair of parallel side edges 164, 166, the ends of which are interconnected by scalloped lower arcuate edges 168, 170 and scalloped upper arcuate edges 172, 174. Opening 162 extends throughout wall 77 and a portion of each of walls 75, 79, with edges 172, 174 and 168, 170 being spaced an equal distance below and above front side perforations 74, 76, respectively.

Openings 138, 162 lie along a common longitudinal axis, which is spaced from and parallel to the longitudinal axes of openings 40 and 86 and the axis of symmetry of openings 118, 120.

To construct package 10, the blank of FIG. 2 is first folded to its configuration illustrated in FIG. 3, in which walls 67 and 69 cooperate to define upper V-shaped rib 32, walls 79 and 81 cooperate to define lower V-shaped rib 34, and walls 73, 75 cooperate to define intermediate V-shaped rib 36.

Walls 65, 71 and 77 are not folded, such that ribs 32, 34 and 36 extend outwardly therefrom. Walls 65, 71 and 77 lie in a common plane. Either before or after folding the blank of FIG. 2 to its folded condition of FIG. 3, an adhesive 176 is applied to the rear surface of wall 65, an adhesive 178 is applied to the rear surface of wall 71, an adhesive 180 is applied to the rear surface of wall 77, and an adhesive 182 is applied to the rear surface of flap 85. Alternatively, the adhesive could be applied in corresponding locations on rear panel 30.

With the package blank of FIG. 2 in its folded condition of FIG. 3, a pair of batteries 16 are placed into openings 118, 120 in a manner as shown in FIG. 3, wherein arcuate end walls 122, 124 and 130, 132 of openings 118, 120, respectively, engage and cradle batteries 16 such that the longitudinal axes of batteries 16 are substantially parallel to the plane of walls 65, 71 and 77. One end of each battery 16 is enclosed by lower rib 34, and the opposite end of each battery 16 is enclosed by intermediate rib 36. A portion of each battery 16 is exposed between walls 75, 79. Batteries 16 are preferably placed into the position of FIG. 3 utilizing rear-to-front movement of batteries 16 so as to bring the side wall of each battery 16 into engagement with arcuate end walls 122, 124 and 130, 132 of openings 118, 120, respectively.

Either before or after placement of batteries 16, flashlight 12 is placed into its FIG. 3 position. This is preferably done by moving flashlight 12 in a rear-to-front direction into opening 86. The butt end of flashlight 12 passes through the lower portion of opening 86 such that the lower end of flashlight handle 20 engages curved end wall 88 and the remainder of handle 20 passes between side edges 90, 92 of opening 86. The head end of flashlight 12 is moved in a rear-to-front direction such that flashlight head 22 is positioned within the upper end of opening 86 between walls 98, 100. Lip 24 of flashlight head 22 is received within the narrow spaces between upper converging edges 110, 112 of opening 86 and the adjacent portion of tab edge 116. Edges 110, 112 and 116 engage the inner and outer surfaces of lip 24, and staggered edges 106, 108 engage the end of lip 24 at spaced locations. Simultaneously, truncated circular tab 114 is pivoted clockwise about rear side perforation 66 and held in position and, after flashlight 12 is in its FIG. 3 position, is returned to its FIG. 3 position so as to engage the inner edge of lip 24, and the end of tab 114 opposite rear side perforation 66 is engaged within the recess defined by lip 24 with the lens of flashlight 12. This functions to retain flashlight 12 in its FIG. 3 position, wherein the butt end of flashlight 12 is enclosed within intermediate rib 36 and the head end of flashlight 12 is engaged by tab 114 and the edges of opening 86 in wall 69 of rib 32. The upper end of opening 86 is configured such that the distance between convergent angled edges 110, 112 is less than the diameter of lip 24, to allow only a small portion of lip 24 to project outwardly from the fold of upper rib 32.

With flashlight 12 in its FIG. 3 position, the longitudinal axis of flashlight 12 is parallel to the longitudinal axes of batteries.16 and to the plane of walls 65, 71 and 77. A portion of flashlight head 22 extends above walls 65, 71 and 77.

Flashlight 14 is placed into opening 138 in a manner similar to that described with respect to flashlight 12, such that its butt end is engaged with and cradled by transverse end wall 140 of opening 138 and its head end is engaged within the upper portion of opening 138 between side edges 150, 152. Flashlight 14 includes an outwardly projecting lip like lip 24 of flashlight 12, which is received within the spaced upper ends of opening 138 between tab 160. Tab 160 extends into the recess defined by the lip of flashlight 14, such that transverse upper edge 160 of tab 158 engages the lens of flashlight 14 and the inner surface of the lip of flashlight 14. In this manner, flashlight 14 is retained in a position in which its longitudinal axis is oriented parallel to the plane of walls 65, 71 and 77. Batteries 18 are placed into opening 162 in a side-by-side manner, being engaged and cradled by arcuate edges 168, 170, 172 and 174 of opening 162. Batteries 18 are thus maintained in a position like that of batteries 16, in which their longitudinal axes are oriented parallel to the plane of walls 65, 71 and 77.

As with flashlight 12 and batteries 16, the butt end of flashlight 14 is enclosed by rib 36, and is engaged with the upper ends of batteries 18 within rib 36. The opposite ends of batteries 18 are enclosed within rib 34. The portion of batteries 18 between ribs 34 and 36 is exposed, as is the portion of flashlight 14 between ribs 32 and 36.

With flashlights 12, 14 and batteries 16, 18 positioned in the manner described, rear panel 30 is folded onto front panel 28 in the direction of arrow 184 (FIG. 3), such that the portions of rear panel 30 facing the rear surfaces of unfolded walls 65, 71 and 77 engages adhesive areas 176, 178 and 180 to adhere rear panel 30 and front panel 28 together. Flap 85 is then folded over the outer edge of rear panel 30 in the direction of arrow 186 (FIG. 3) such that adhesive 182 on its rear surface engages the rear surface of rear panel 30. Upon such folding of flap 85, cut-outs 82, 84 form a pair of feet 188, 190 (FIGS. 4, 5, respectively).

Figure 5:
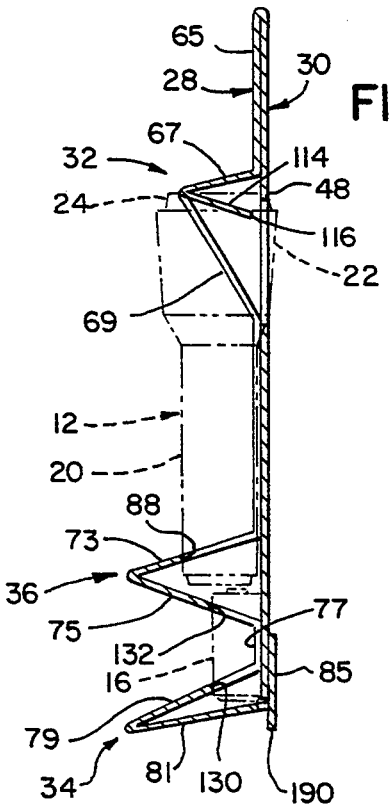
FIG. 5 is a section view taken along line 5—5 of FIG. 1.

Upon folding of rear flap 30 as described, the rear portion of flashlight head 22 is received within opening 40 in rear panel 30, so as to extend therethrough in a manner as illustrated in FIG. 5. Tab 48 defined by opening 40 in rear flap 30 is forced over lip 24 of flashlight head 22, such that the opposite ends of its edge 54 engage the inner surface of lip 24 at a pair of spaced locations. This functions to assist truncated circular flap 114 and edges 110, 112 of opening 86 in retaining flashlight 12 in its FIG. 5 position.

Figure 4:
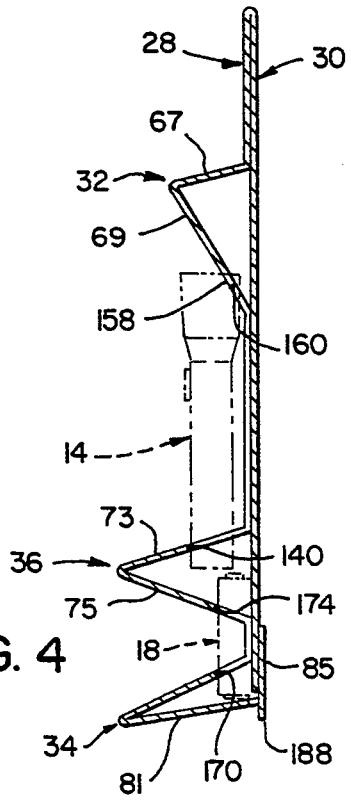
FIG. 4 is a section view taken along line 4—4 of FIG. 1.

As shown in FIGS. 4 and 5, the positioning of rear flap 30 against front flap 28 functions to capture flashlights 12, 14 within ribs 32, 36 and batteries 16, 18 within ribs 34, 36. Flashlights 12, 14 and batteries 16, 18 are captured in a manner preventing their removal from package 10 in a rear-to-front direction without destroying at least a portion of package 10, while exposing a substantial portion of the length of flashlights 12, 14 and batteries 16, 18 for allowing the potential purchaser to view and touch such articles prior to purchase.

As noted previously, the lower ends of batteries 16, 18 are engaged with the inner surface of wall 81 defining lower rib 34. The upper end of flashlight 12 is engaged with edges 106, 108 of opening 86, and likewise the upper end of flashlight 14 is engaged with the upper transverse edges of opening 138 adjacent angled edges 154, 156. The upper ends of batteries 16, 18 engage the butt ends of flashlights 12, 14, respectively within the interior of rib 36, to maintain flashlights 12, 14 and batteries 16, 18 in longitudinal position within package 10.

When rear panel 30 is folded onto front panel 28, hang opening 60 in rear panel 30 comes into alignment with a similarly configured hang opening 191 (FIG. 2) formed in front panel upper wall 65. For display purposes, package 10 can either be hung by a hook extending through hang openings 60 and 191 or alternatively can be stood upright as shown in FIGS. 4 and 5, wherein feet 188, 190 and the outer end of lower rib 34 function to support package 10 in a substantially vertical position.

Figure 6:
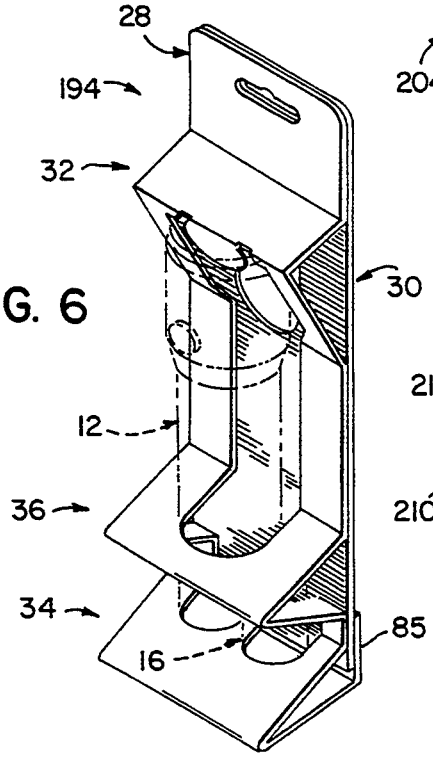
FIG. 6 is an isometric view similar to FIG. 1, showing another embodiment of the package of the invention.

FIG. 6 illustrates an alternate embodiment for a package 194 constructed according to the invention. This embodiment is nearly identical in all respects to the portion of package 10 which functions to package flashlight 12 and its batteries 16, as shown and described with respect to FIGS. 1–5. Like reference characters are shown in FIG. 6 for clarity in understanding.

Figure 7:
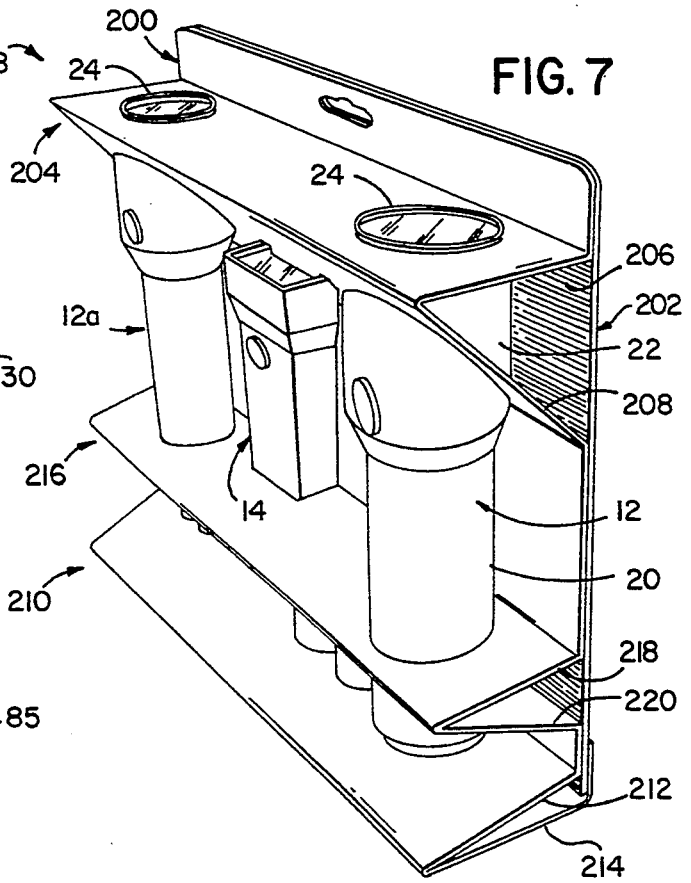
FIG. 7 is an isometric view similar to FIGS. 1 and 6, showing yet another embodiment of the package of the invention.

FIG. 7 illustrates another embodiment of a package 198 constructed according to the invention. Package 198 provides a package construction for packaging a pair of differently sized flashlights 12, 12*a* and a flashlight 14 therebetween. Generally, package 198 consists of a front panel 200 and a rear panel 202, secured together in substantially the same manner as described with respect to front and rear panels 28, 30 of package 10. Front panel 200 of package 198 is formed to provide an upper rib 204 defined by a pair of walls 206, 208, a lower rib 210 formed by a pair of walls 212, 214, and an intermediate rib 216 defined by a pair of walls 218, 220. The unfolded portions of front panel 28 between ribs 204, 210 and 216 are adhered to rear panel 202 using adhesive or the like, in the same manner as described with respect to package 10.

Flashlight 14 and its batteries 18 are engaged and secured within package 198 in the same manner as described with respect to package 10 of FIGS. 1–5.

Flashlights 12, 12*a* are retained in position in package 198 in a different manner than that of package 10 of FIGS. 1–5. In the FIG. 7 embodiment, the butt ends of flashlights 12, 12*a* are engaged with the upper surface of wall 212 of lower rib 210. Aligned circular openings are formed in walls 218, 220 of intermediate rib 216, through which the lower end of handle 20 of each flashlight 12 extends. Similarly, an elliptical opening is formed in lower wall 208 of rib 204, and a circular opening is formed in upper wall 206 of rib 204. When package 198 is in its assembled condition of FIG. 7, the openings in walls 206, 208 of upper rib 204 and in walls 218, 220 of intermediate rib 216 lie along a common axis. Lip 24 defined by the outer end of flashlight head 22 extends through the circular opening formed in upper wall 206 of upper rib 204. With this construction, flashlights 12, 12*a* are positively retained within package 198 against frontward-rearward movement by engagement of flashlight handle 20 with intermediate rib 216 and engagement of flashlight head 22 with upper rib 204. Longitudinal movement of flashlights 12, 12*a* is prevented by engagement of the butt end of flashlights 12, 12*a* with the upper surface of lower rib upper wall 212 and engagement of the shoulder from which lip 24 extends with the inner surface of upper rib upper wall 206.

In order to insert each of flashlights 12, 12*a* into the package of FIG. 7, handle 20 of each flashlight must first be inserted in a longitudinal direction through the elliptical opening formed in wall 208 of upper rib 204, and then through the aligned circular openings formed in walls 218, 220 of intermediate rib 216 until the butt ends of flashlights 12, 12*a* engage upper wall 212 of lower rib 210. Thereafter, upper wall 206 of upper rib 204 is folded to its FIG. 7 position, such that lip 24 extends through the circular opening formed in wall 206. Rear panel 202 is then adhered to the unfolded walls of front panel 200.

It is understood that the construction of package 198 for packaging flashlights 12, 12*a* could be employed in a single package in which one flashlight is packaged, either by itself or with its associated batteries 14. Likewise, it is understood that the same construction of upper rib 32 of package 10 could be used in the package of FIG. 7, with the lower end of flashlight 12 being retained in the same manner as the package of FIG. 7.

Other similarly constructed packages for displaying any other elongated object, or combination of objects such as flashlights with or without batteries, are contemplated as being within the scope of the present invention.

Various alternatives and embodiments are contemplated as being within the scope of the following claims particularly pointing out and distinctly claiming the subject matter regarded as the invention.

I claim:

1. A package for an elongated object defining spaced first and second ends, comprising:

a rear panel against which the object is located;

a front panel secured to the rear panel;

a first outwardly extending V-shaped rib formed in the front panel by a pair of walls with a fold line therebetween, the first rib having an opening for receiving the first end of the object;

a second outwardly extending V-shaped rib formed in the front panel by a pair of walls with a fold line therebetween, the second rib having an opening for receiving the second end of the object;

wherein the first and second ribs are arranged such that at least a portion of the object between its first and second ends is exposed therebetween and wherein the openings formed in the first and second ribs are formed in facing walls of the first and second ribs such that the edges of the first and second ribs adjacent each opening engage the object adjacent its first and second ends, respectively;

a third outwardly extending V-shaped rib formed in the front panel, the third V-shaped rib being formed by a pair of walls with a fold line therebetween; and wherein the rear panel functions to retain the object adjacent its first and second ends in engagement with the first and second ribs respectively.

2. The package of claim 1, wherein the second rib is located between the first and third ribs, wherein the second and third ribs define facing walls, and further comprising an opening formed in each of the facing walls of the second and third ribs for receiving one or more second objects therein, wherein a portion of each second object between the second and third ribs is exposed therebetween.

3. The package of claim 2, wherein the first objects comprises a flashlight and wherein the one or more second objects comprise one or more batteries for use with the flashlight.

4. The package of claim 2, wherein the second rib is located and the first and second objects arranged such that a first end of each of the second objects extends through the opening in the facing wall of the second rib such that the first end of each second object is enclosed by the second rib and the second end of the first object extends through the opening formed in the opposite wall of the second rib such that the second end of the first object is enclosed by the second rib, and wherein the second end of the first object and the first end of the second object are engaged with each other within the second rib.

5. The package of claim 4, wherein the second end of the second object extends through the opening formed in the wall of the third rib facing the second rib and engages the opposite wall of the third rib.

6. A package for an elongated object defining spaced first and second ends, comprising:

a rear panel against which the object is located;

a front panel secured to the rear panel;

a first outwardly extending rib formed in the front panel and having an opening for receiving the first end of the object, wherein the opening is formed such that at least a portion of the first rib engages the object adjacent its first end;

a second outwardly extending rib formed in the front panel and having an opening for receiving the second end of the object, wherein the opening in the second rib is formed such that at least a portion of the second rib engages the object adjacent its second end;

wherein the first and second ribs are arranged such that at least a portion of the object between its first and second ends is exposed therebetween;

wherein the rear panel functions to retain the object adjacent its first and second ends in engagement with the first and second ribs respectively;

wherein the first and second ribs are V-shaped, with each rib being formed by a pair of walls with a fold line therebetween; and wherein the first rib is defined by an inner wall and an outer wall, and wherein the first end of the object includes a recess, and wherein the opening formed in the first rib comprises an opening formed in the inner wall of the first rib, the opening being formed such that a portion of the inner wall of the first rib defines a cut-out tab, the tab being engaged with the recess in the first end of the object to assist in retaining the object in engagement with the first rib.

* * * * *